United States Patent [19]

Prodyma

[11] 4,384,910

[45] May 24, 1983

[54] METHOD OF EXTENDING A SOIL PIPE FLANGE

[76] Inventor: Timothy J. Prodyma, 225 Armitage Ave., Northlake, Ill. 60164

[21] Appl. No.: 263,198

[22] Filed: May 13, 1981

[51] Int. Cl.[3] ..... B32B 7/08; E03D 11/13

[52] U.S. Cl. ..... 156/92; 4/252 R; 4/288; 4/DIG. 7; 4/DIG. 9; 156/294; 285/56; 285/58; 428/36; 428/131

[58] Field of Search ..... 4/252 R, DIG. 7, DIG. 9, 4/288; 156/91, 294, 92; 285/56, 58; 428/36, 131; 16/108, 109

[56] References Cited

U.S. PATENT DOCUMENTS 2,908,513 10/1959 Karlinski ..... 285/58
3,846,851 11/1974 Pepper ..... 4/252 R
3,896,510 7/1975 O'Connell ..... 285/56 X
4,090,267 5/1978 Cuschera ..... 4/252 R X

*Primary Examiner*—Robert A. Dawson
*Attorney, Agent, or Firm*—Irwin C. Alter

[57] ABSTRACT

An improved method for extending a soil pipe flange to floor level by attaching thereto an improved extension device. An extension collar is positioned over a soil pipe flange on which a bead of mastic has been applied. The extension collar, which is made from a flexible material and has multiple attachment slots, is secured to the soil pipe flange by upward extending bolts, and bolt hardware. A wax ring is positioned above the extension collar at floor level. This extended flange facilitates attachment of a toilet fixture to the soil pipe. The method includes techniques for adding multiple extension collars and thus, if required, further extending the soil pipe flange.

5 Claims, 4 Drawing Figures

METHOD OF EXTENDING A SOIL PIPE FLANGE

BACKGROUND OF THE INVENTION

This invention relates in general to pipes and piping, and more particularly to an improved method for extending a soil pipe flange to floor level.

The pipe located beneath a toilet, through which waste water is deposited, is commonly known as a soil pipe. Often, in remodeling a bathroom, the toilet fixture is replaced. Once the toilet is removed from its mountings, it is not unusual to discover that the soil pipe to which it was connected has settled below floor level. This creates a gap between the soil pipe flange and the new toilet assembly. A new toilet cannot be installed until the soil pipe flange is raised to floor level.

In the past, a soil pipe was raised to floor level by removing the old soil pipe flange, and replacing it with a new collar and flange assembly. The new flange would extend to floor level and the new toilet assembly could be installed.

Removing an old soil pipe flange can be a very difficult operation. A workman must carefully operate a saw in the small space normally provided around the soil pipe. Due to the brittle nature of an old soil pipe, it is often very difficult to obtain a clean cut. If the soil pipe breaks or cracks while being cut, extensive replacement work might be required. If the old flange is successfully removed, one must cope with the expense and questionable availability of a new collar and flange assembly. A new collar and flange assembly is often difficult to install and usually creates a new weak area on the pipe, which may cause the pipe to burst.

It is thus an object of the present invention to provide an improved method for extending a soil pipe flange to floor level.

An additional object of the invention is to provide an economical method for extending a soil pipe flange to floor level.

A further object of the invention is to provide a method for extending a soft pipe flange to floor level in which the only tools required are a small Crescent wrench or pliers.

A still further object of the invention is to provide a reliable method for extending a soil pipe flange to floor level.

A still further object of the invention is to provide an inexpensive and reliable extension collar.

These and other objects of the invention will become apparent in light of the present specification, and upon considering the accompanying drawings.

SUMMARY OF THE INVENTION

The present invention is an improved extension device and method for extending a soil pipe flange to floor level.

The method for extending a soil pipe flange utilizes an improved extension collar, a wax ring, and threaded bolts and hardware. The steps include removing all foreign matter from the soil pipe flange, applying a bead of mastic to the soil pipe flange, positioning at least one extension collar over the soil pipe flange, inserting threaded bolts upward through aligned slots in the soil pipe flange and the extension collar, fastening washers and threaded nuts to the threaded bolts, and positioning a sealing ring such as a wax ring over the extension collar.

In a preferred embodiment, multiple extension collars are required to extend a soil pipe flange to floor level. In addition to the above-described steps, a bead of mastic is applied to the top of the extension collar after it is positioned over the soil pipe flange. A second extension collar is then positioned over the first extension collar. These two steps are repeated until the desired flange height is achieved. Once the desired flange height is achieved, the remaining above-described steps are completed.

The threaded bolts that extend through aligned slots in the soil pipe flange, the extension collar and wax ring, extend above floor level. When a toilet fixture is positioned over the extended flange, the threaded bolts protrude through bolt holes provided in the toilet fixture base. Installation of the toilet is completed when cap nuts are fastened to the protruding bolts, and the toilet fixture is secured to the soil pipe.

The extension device is a flexible collar. The flexible collar has a rim of equal size to that of the soil pipe flange. The rim has two attachment slots located on opposite sides of the flexible collar. The flexible collar is made of a water-resistant material such as polyvinyl chloride and is capable of withstanding internal water pressure.

DETAILED DESCRIPTION OF THE DRAWINGS

Figure 1:
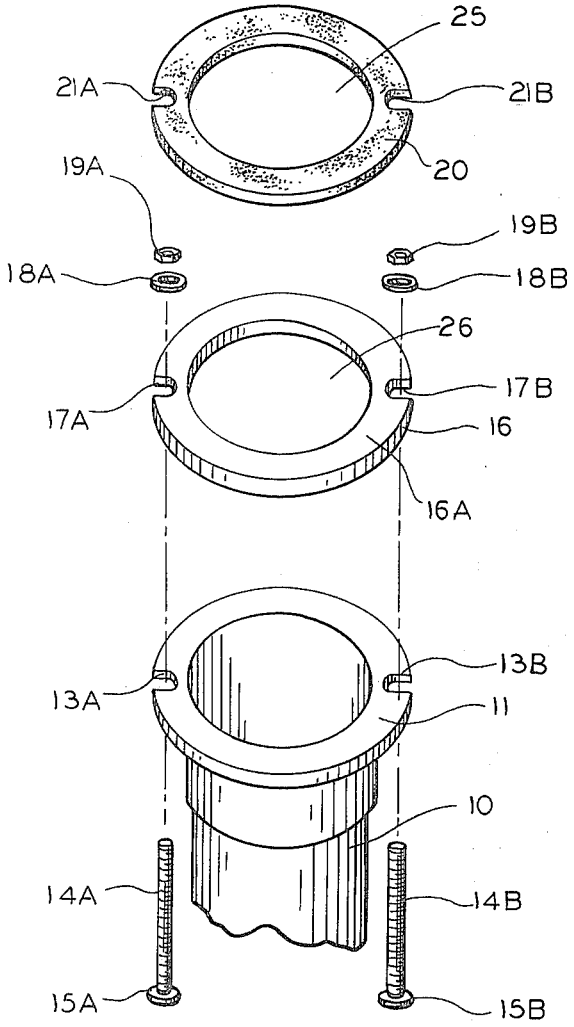
FIG. 1 is a side perspective view of the soil pipe flange and extension components.

While this invention is susceptible of embodiment in many different forms, there is shown in the drawings and will herein be described in detail, several specific embodiments, with the understanding that the patent disclosure is to be considered as an exemplification of the principles of the invention and is not intended to limit the invention to the embodiments illustrated.

Soil pipe 10 is shown in FIG. 1 having flange 11. Located on opposite sides of flange 11 are flange slots 13*a* and 13*b*, each having a sufficiently large diameter so as to receive threaded bolts 14*a* and 14*b*. Bolt heads 15*a* and 15*b* have a sufficiently large diameter so as not to pass through flange slots 13*a* and 13*b*. Therefore, when threaded bolts 14*a* and 14*b* are extended through flange slots 13*a* and 13*b*, bolt heads 15*a* and 15*b* are biased against the flange 11.

Extension collar 16 has extension collar slots 17*a* and 17*b* located on extension collar rim 16*a*. Extension collar rim 16*a* is similar in size to soil pipe flange 11, and extension collar slots 17*a* and 17*b* have an orientation and diameter which is similar to flange slots 13*a* and 13*b*. Extension collar 16 is superimposed over flange 11, with threaded bolts 14*a* and 14*b* extending through extension collar slots 17*a* and 17*b*. Extension collar 16 is secured to flange 11 by attaching washers 18*a* and 18*b*, and threaded nuts 19*a* and 19*b* to threaded bolts 14*a* and 14*b*.

Wax rings 20 has wax ring slots 21*a* and 21*b* which have an orientation and diameter similar to flange slots 13*a* and 13*b*, and extension collar slots 17*a* and 17*b*. Wax ring 20 is a deformable seal, and though bolts 14*a* and 14*b* extend through slots 17*a* and 17*b*, no attachment hardware is required to secure wax ring 20 to extension collar 16.

Figure 2:
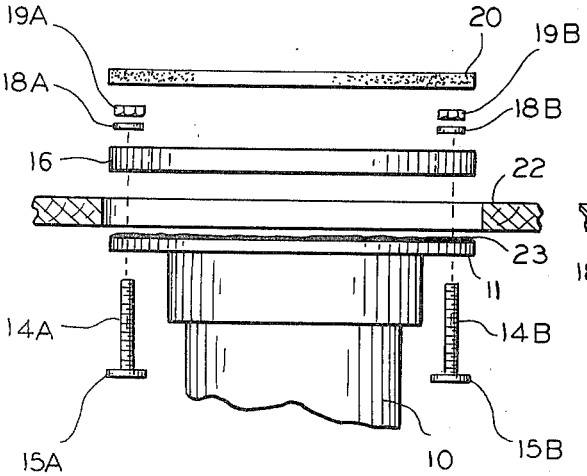
FIG. 2 is a side elevational view of the soil pipe flange and extension components.

FIG. 2 is a side view showing the position of the components hereinabove described relative to floorboard 22. As shown in FIG. 2, soil pipe 10 and soil pipe flange 11 are located substantially below the upper surface of floorboard 22. Applying a bead of mastic to soil pipe flange 11 is a first step in extending soil pipe flange 11 to the upper surface of floorboard 22. While mastic 23 is still mucilaginous, extension collar 16 is superimposed on soil pipe flange 11. When mastic 23 solidifies, it will provide a watertight seal between extension collar 16 and flange 11. When extension collar 16 is placed on flange 11, extension collar slots 17*a* and 17*b* must be correctly aligned with flange slots 13*a* and 13*b*. Slot alignment facilitates insertion of threaded bolts 14*a* and 14*b*. Washers 18*a* and 18*b*, and threaded nuts 19*a* and 19*b* fasten to threaded bolts 14*a* and 14*b* extending above extension collar 16. A crescent wrench or pliers can be used to tighten threaded nuts 19*a* and 19*b*, and secure extension collar 16 to soil pipe flange 11. Wax ring 20 is positioned over extension collar 16 and provides a watertight seal between extension collar 16 and the toilet fixture being installed.

Figure 3:
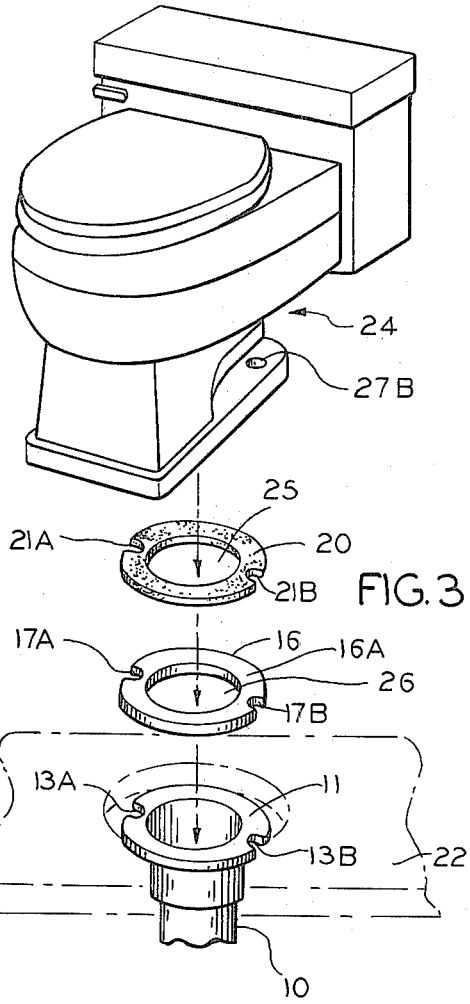
FIG. 3 is a side perspective view of the soil pipe flange and extension components, below a toilet fixture.

In FIG. 3, toilet fixture 24 is shown above wax ring 20, extension collar 16 and soil pipe flange 11. Waste water passes through wax ring opening 25 and extension collar opening 26, and is deposited into soil pipe 10. Toilet fixture 24 is oriented such that toilet fixture bolt hole 27*b* is aligned with wax ring slot 21*b*, extension collar slot 17*b* and flange slot 13*b*. A second toilet fixture bolt hole 27*a* is shown in FIG. 4, and is aligned with wax ring slot 21*a*, extension collar slot 17*a* and flange slot 13*a*.

Figure 4:
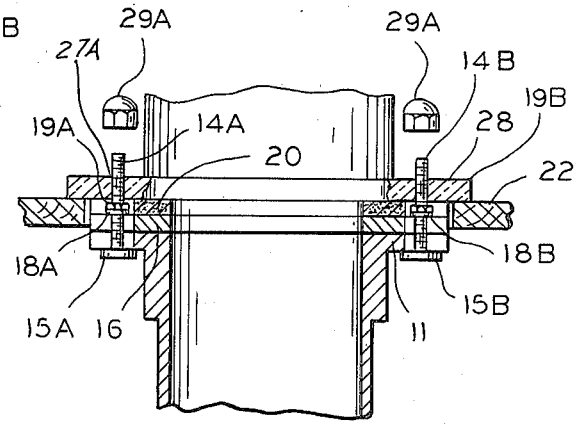
FIG. 4 is a cross-sectional view of the soil pipe flange and extension components connecting to a toilet fixture.

FIG. 4 shows toilet fixture 24 on floorboard 22, aligned with soil pipe 10. Threaded bolts 14*a* and 14*b* extend through flange slots 13*a* and 13*b*, extension collar slots 17*a* and 17*b*, wax ring slots 21*a* and 21*b*, and toilet fixture bolt holes 27*a* and 27*b*. Washers 18*a* and 18*b*, and threaded nuts 19*a* and 19*b* are interposed between toilet fixture base 28 and extension collar 16 on threaded bolts 14*a* and 14*b*. Cap nuts 29*a* and 29*b* also fasten to threaded bolts 14*a* and 14*b* which protrude above toilet fixture base 28, and secure toilet fixture 24 to soil pipe 10.

In a preferred embodiment, multiple extension collars similar to extension collar 16, are attached to soil pipe flange 11. A bead of mastic, similar to the bead of mastic 23 applied to soil pipe flange 11, must be applied between each such collar. The bead of mastic provides a watertight seal between each of the multiple collars.

The foregoing description and drawings merely explain and illustrate the invention. The invention is not limited thereto, except insofar as the appended claims are so limited, as those skilled in the art who have the disclosure before them will be able to make modifications and variations therein without departing from the spirit and scope of the invention.

What is claimed is:

1. A method for extending a soil pipe flange to floor level, comprising the steps of:
   (a) removing all foreign matter from said soil pipe flange;
   (b) applying a bead of mastic to the upper surface of said soil pipe flange;
   (c) positioning a first substantially flat extension collar over said soil pipe flange, said collar having a substantially planar lower surface for cooperation with said mastic, and a substantially flat continuously planar upper surface for cooperation with a sealing ring member, said collar further including a rim correlating in size to and aligned with the flange portion of said soil pipe member;
   (d) applying a bead of mastic to a second extension collar of the same shape as said first extension collar;
   (e) positioning said second extension collar over said first extension collar; and
   (f) fastening said extension collars to said soil pipe flange by insertion of threaded fastening devices emanating directly from said soil pipe flange through the collars to the upper surface of said first flexible collar member for constraint of the collars.

2. A method according to claim 1 wherein the steps of extending the soil pipe flange include applying further extension collars by repeating the procedures of positioning and fastening said collars to in effect achieve the desired flange height.

3. The method according to claim 1 wherein the following steps are interposed after step (f):
   (f1) inserting threaded bolts upward through aligned slots in said soil pipe flange and said extension collars; and
   (f2) fastening washers and threaded nuts to said threaded bolts.

4. The method according to claim 1 in which said flexible collars are made from a water-resistant material.

5. The method according to claim 4 in which said water-resistant material is polyvinyl chloride.

* * * * *